US005263660A

United States Patent [19]

Brozik

[11] Patent Number: 5,263,660

[45] Date of Patent: Nov. 23, 1993

[54] ANTI-TWO BLOCK DEVICE

[75] Inventor: James Brozik, Britt, Iowa

[73] Assignee: Iowa Mold Tooling Company, Inc., Garner, Iowa

[21] Appl. No.: 568,979

[22] Filed: Aug. 17, 1990

[51] Int. Cl.[5] ..... B66C 23/90; B66D 1/48

[52] U.S. Cl. ..... 254/269; 212/152

[58] Field of Search ..... 212/152; 254/269, 270, 254/325, 326, 327

[56] References Cited

U.S. PATENT DOCUMENTS

| | | | |
|---|---|---|---|
| 2,428,578 | 10/1947 | Nelles | 254/269 |
| 2,778,506 | 1/1957 | Harry | 254/269 |
| 3,969,714 | 7/1976 | Greer | 212/152 X |
| 4,170,308 | 10/1979 | Rogers | 254/269 X |
| 4,280,628 | 7/1981 | Goss et al. | 212/152 X |
| 4,447,043 | 5/1984 | Bocchiaro | 254/269 |
| 4,591,131 | 5/1986 | Rhoads | 254/269 |
| 4,804,095 | 2/1989 | Rohr et al. | 212/152 |

FOREIGN PATENT DOCUMENTS

| | | | |
|---|---|---|---|
| 1073709 | 1/1960 | Fed. Rep. of Germany | 254/269 |
| 512303 | 1/1955 | Italy | 254/269 |
| 1404444 | 6/1988 | U.S.S.R. | 212/152 |

*Primary Examiner*—Katherine Matecki

*Attorney, Agent, or Firm*—Wood, Phillips, VanSanten, Hoffman & Ertel

[57] ABSTRACT

An anti two-blocking device for preventing a lower load block (46) on a crane (10) from coming in contact with an upper load block (44) affixed adjacent a boom point (40). The device comprises a cable follower (60) through which the crane's cable (26) is threaded, situated between the upper load block (44) and the lower load block (46). When the lower load block (46) is within a predetermined distance of the upper load block (44), the lower load block (46) reaches the cable follower (60) and exerts an upwards force which causes the cable follower (60) to activate an actuator (70) for a switch (72). The switch (72) deactivates all activity on the crane (10) which could cause the lower load block (46) to come in contact with upper load block (44). This activity includes lowering the boom (30), reeling in the cable (26) and extending the telescoping sections of the boom (32 and 33).

15 Claims, 3 Drawing Sheets

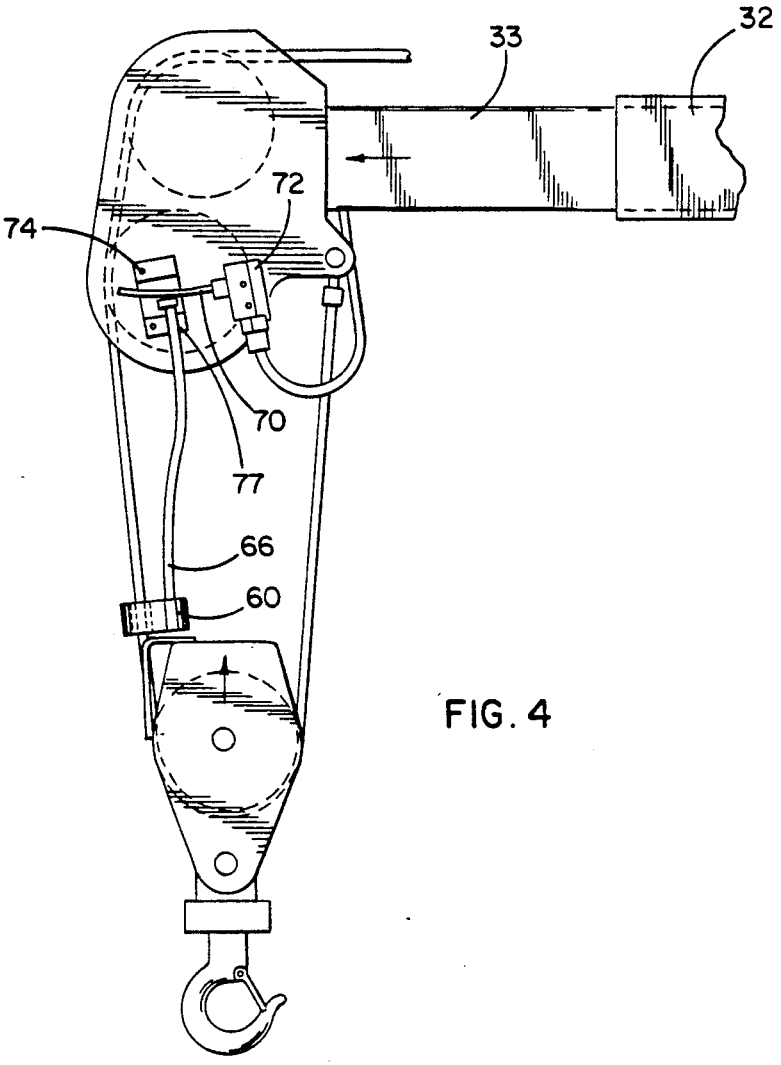
FIG. 4
FIG. 5
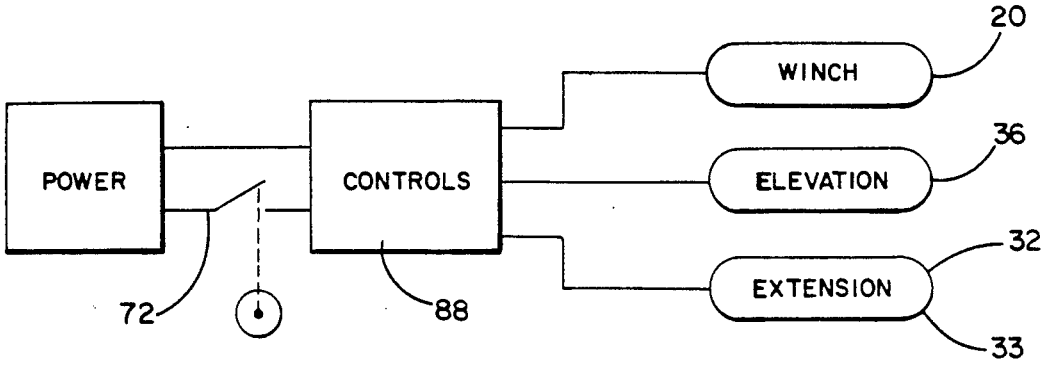

ANTI-TWO BLOCK DEVICE

FIELD OF THE INVENTION

This invention relates to safety controls for cranes and more particularly to anti-two block devices for self-propelled cranes having extension booms.

BACKGROUND OF THE INVENTION

Cranes are used to raise, shift and lower heavy objects or loads by means of a projecting, swinging arm or boom in conjunction with a hoisting apparatus. The hoisting apparatus can comprise a cable extending adjacent the boom, wound around a sheave situated near the inner end of the boom at one end, and having a load block assembly attached at the other end. The load block assembly can consist of an upper load block or boom point sheave assembly attached at the outer end of the boom or boom point and a lower load block or hook assembly, which includes a movable sheave and a load attachment means. The cable extends past the upper load block to support the lower load block. During the normal course of operation of the crane, the lower load block is maintained at a distance below the upper load block.

Such a crane can contain various moving parts which are coordinated to facilitate the attachment and transportation of objects. The boom can have the capacity for being elevated and lowered, as well as having extendable and retractable telescoping boom sections. Additionally, the cable can be reeled in and let out over the inner boom sheave. The retrieval and transportation of a load is achieved through various combinations of reeling in and paying out the cable, raising and lowering the boom, and extending and retracting the telescoping boom sections.

There is a danger, during the operation of the crane, of the lower load block coming in contact with the boom point, upper load block or other components attached thereon. Such contact could result in costly damage to the crane or its load. The cable could break resulting in the load and lower load block falling to the ground. The load could detach from the lower load block and fall. Alternatively, the load block could move over the boom point with the resulting interference damaging the components at their point of contact. Each possibility is clearly undesirable.

"Two-blocking" refers to the condition when the lower load block comes in contact with the upper load block. Extending or lowering the boom without sufficiently unwinding the cable and reeling in the cable too far can cause two blocking. As mentioned previously, it is important that the lower load block be prevented from coming with the upper load block. Therefore, cranes installed with a load block assembly would benefit greatly from an anti-two block device.

There are safety control systems adapted for installation on extension booms that prevent two-blocking. In a typical system, a switch is installed near the upper load block. The switch has a lever with a chain and a weight attached thereon. The cable is threaded through the weight. The weight maintains the switch in the working position. As the lower load block comes in contact with the weight, the tension in the chain relaxes, thereby releasing the lever of the switch which stops all activity which could endanger the boom apparatus.

There are problems with the prior safety control devices such as the one just described. The weight continually exerting a force on the switch causes a stress on the switch and shortens its life span, thus reducing the reliability of the device.

The present invention overcomes one or more of the foregoing problems and achieves one or more of the aforementioned objectives.

SUMMARY OF THE INVENTION

An object of the invention is to provide an anti-two block device for use with a crane assembly for preventing a lower load block of the crane from coming in contact with an upper load block. The device comprises a switch including a switch actuator for controlling the movements of the lower load block, a cable follower, for sensing the presence of the lower load block within a predetermined distance from the upper load block, and a flexible rod attached to the cable follower engageable with the switch actuator. When the lower load block comes in contact with the cable follower, the flexible rod moves to deactivate the switch so that all movement of the crane assembly which causes the movement of the lower load block towards the upper load block is stopped.

In an embodiment where the crane assembly includes a boom and means for raising and lowering the boom, deactivation of the switch causes the boom to stop being further lowered. In an embodiment where the crane assembly includes telescoping boom sections and means for extending and retracting the boom sections, deactivation of the switch halts further extension of the boom. In an embodiment where the crane apparatus includes a cable attached between the lower and upper load blocks, and a means for reeling in and letting out the cable, deactivation of the switch causes the reeling in of the cable to be halted.

Another object of this invention is to provide a device for preventing two blocking in a crane having a boom with inner and outer ends, a lower load block including a movable sheave and a load attaching means, an upper load block attached adjacent the upper end of the boom, a hoisting cable extending vertically past the upper load block and supporting the lower load block, and a hoisting mechanism for reeling and letting out the cable. This device comprises a cable follower positioned between the upper and lower load blocks, a switch fixedly attached adjacent the upper load block, a switch actuator on the switch, and a flexible rod having lower and upper ends, attached to the cable follower at the lower end and having the upper end movably mounted adjacent the switch actuator to engage the switch actuator when the follower is engaged by the lower load block. The switch is adapted to control the movements of the crane so that engagement of the switch actuator by the rod prevents movements of the crane which might bring the lower and upper load blocks in contact.

In a further embodiment, the cable follower contains an opening greater in diameter than the diameter of the cable and through which the cable freely passes.

A still further objective is to provide a crane apparatus comprising a boom having lower and upper ends, a load block assembly attached at the upper end of the boom and having a lower load block, an upper load block attached to the upper end of the boom and a cable extending vertically past the upper load block and connected to the lower load block. The crane assembly further includes a mechanism for extension and retraction of the cable and a cable follower between the upper load block and the lower load block. The cable follower comprises a flexible rod having upper and lower ends and attached to the cable follower at the lower end. An actuator for a switch is mounted in adjacency to the upper load block, and the upper end of the flexible rod is movably mounted adjacent the actuator to be engaged therewith when the cable follower is engaged by the lower load block. The switch is adapted to control the movement of the load blocks so activation of the switch ceases movement of the load blocks.

In a preferred embodiment, the apparatus includes a housing partially enclosing the switch. The apparatus may also include a lower sheave fixedly attached to the outer end of the extension boom arm around which one end of the cable is wound. The lower load block may also include a movable sheave and means for attaching a load.

Other objects and advantages will become apparent from the following specification taken in connection with the accompanying drawings.

BRIEF DESCRIPTION OF THE DRAWING

The illustrated embodiment of the invention will hereinafter be described in relation to the accompanying drawing wherein:

FIG. 4 is a somewhat schematic side elevation similar to FIG. 3 and showing the configuration of the components after the mechanism has been activated; and FIG. 5 is a schematic of a control for the crane with the anti-two block device.

BEST MODE FOR CARRYING OUT THE INVENTION

Figure 1:
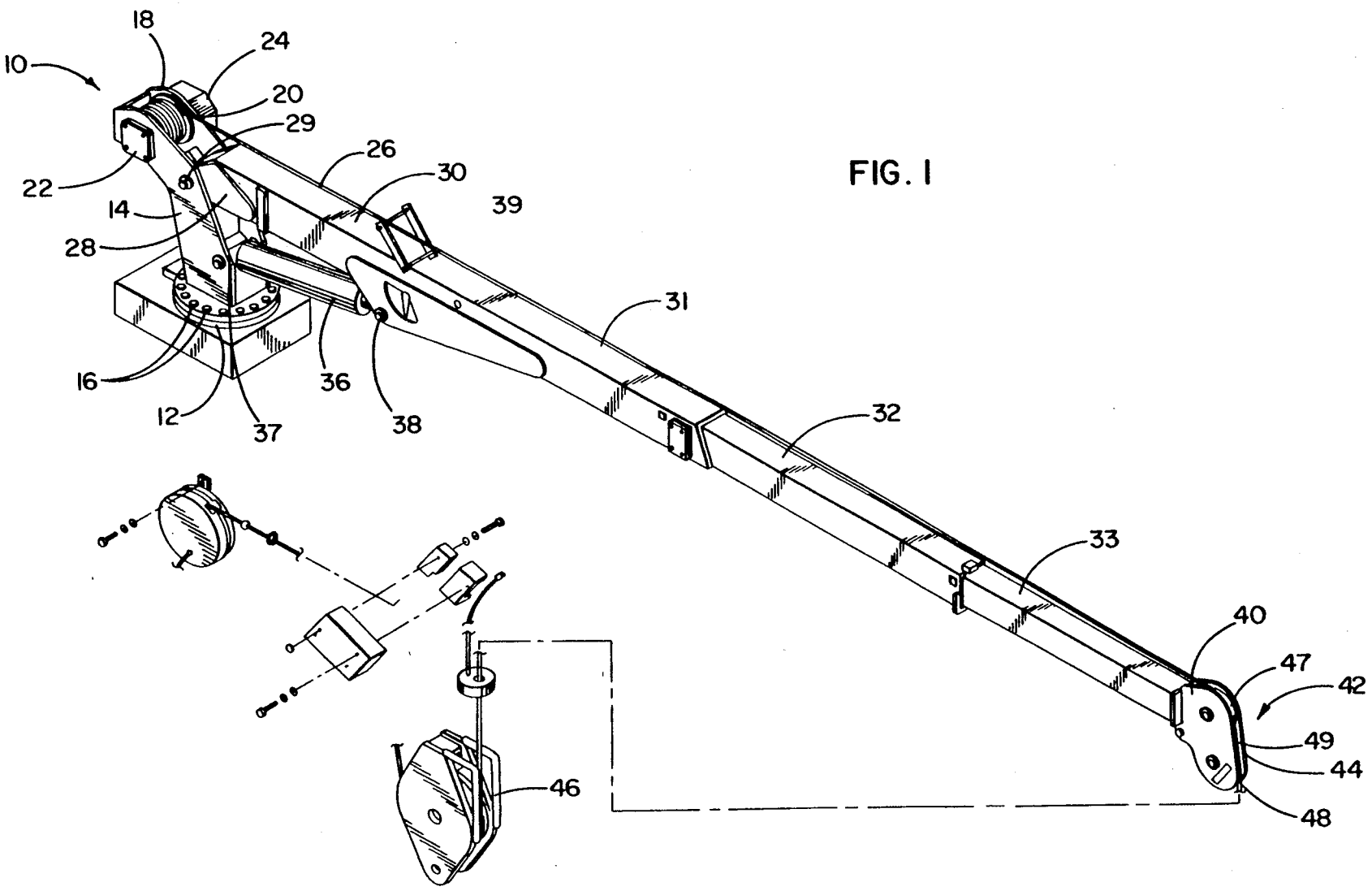
FIG. 1 is a partially exploded perspective view of an anti-two blocking design incorporated in a crane assembly having a telescoping boom arm.

Referring to FIG. 1, a crane assembly is shown generally at 10. The crane consists of a rotatable base 12 on which an upwardly extending, backwardly curving, support structure or mast 14 is securely bolted by means of bolts 16. Towards the top, rearward end 18 of the mast 14, a winch drum 20 is securely attached by means of bolts 22 on a winch drive 24. Controls (not shown) are provided for rotation of the drum 20 in both clockwise and counterclockwise directions in a conventional fashion. A cable 26 is wound around the drum 20 so that rotation of the drum 20 causes the cable 26 to be reeled in or payed out depending on the direction of the rotation.

In front of and below the drum 20 on the support structure 14, a frame 28 on a pivot pin 29 pivotally attaches a boom 30 to the mast 14. The boom 30 comprises a main tube 31 and telescoping tubes 32 and 33. The boom is extended by means of a hydraulic cylinder (not shown) located within the tubes 31, 32 and 33 in a conventional fashion, although the extension of the boom 30 can be effected through electric power if desired. In front of and below the boom pivot frame 28 and above the base 12, a hydraulic cylinder 36 is pivotally attached to the mast 14 by means of a pivot pin 37 and to the boom 30 by a pivot pin 38. The cylinder 36 controls the raising and lowering of the boom 30.

The cable 26 extends along the length of the boom 30. The cable 26 is maintained close to the boom 30 by means of a guidance ring 39. At the top of the outermost telescoping tube 32, or boom point 40, a load block apparatus, generally designated 42, is affixed. The load apparatus 42 comprises an upper and a lower load block, 44 and 46, respectively. The upper load block 44 is affixed adjacent the boom point 40 and comprises a pair of rotatable sheaves 47 and 48 which guide movement of the cable 26 as it is reeled in and let out. A pin 49 confines the cable 26 against the sheaves 47 and 48. The cable 26 extends past the upper load block 44 to support the lower load block 46.

Figure 2:
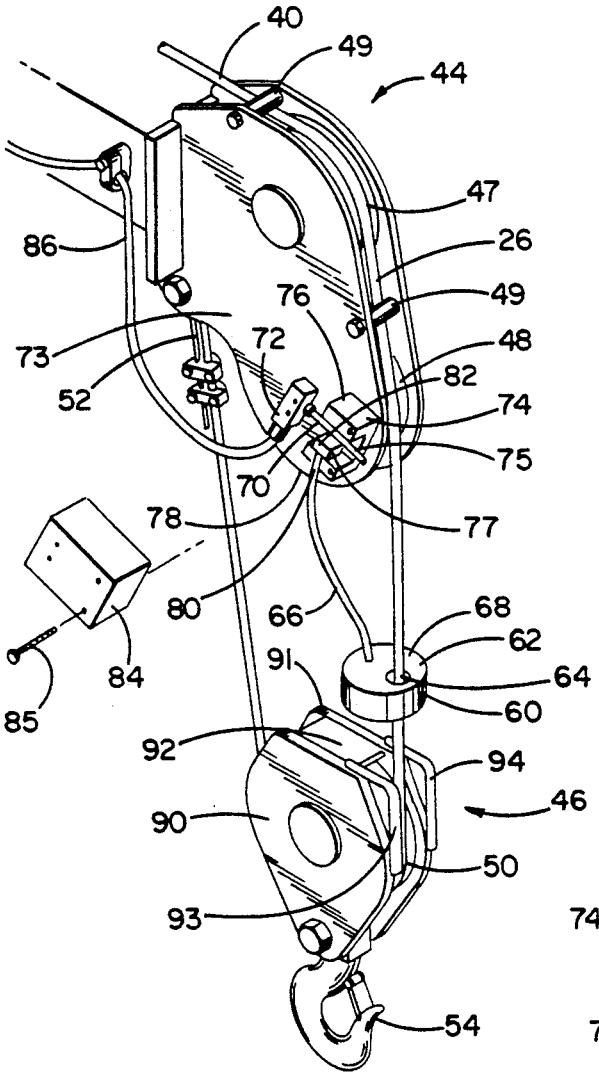
FIG. 2 is an enlarged, fragmentary perspective view of the anti-two block device.

Referring to FIG. 2, the lower load block 46 includes a rotatable sheave 50. The cable 26 wraps around the sheave 5, continues up back towards the upper load block 44 and is attached adjacent the boom point 40 to 52. The lower load block 46 comprises a load attaching means in the form of a hook 54. Other devices could likewise be used for attaching the load to be moved.

The crane operator can use the extension, elevation and winch controls to move the load attachment means 54 to an object, attach the object to the lower load block 46 and then move the object to a destination in a conventional fashion.

During the course of operation of the crane 10, there are at least three ways in which two blocking, that is, the lower load block 46 coming in contact with the upper load block 44, could occur. The first way is when the cable 26 is reeled in two far by the winch drive 24 thereby pulling the lower load block 46 into contact with the upper load block 44. A second way in which two-blocking occurs is when the boom 30 is lowered toward the horizontal and the cable 26 is not payed out sufficiently. This type of two blocking results from the spacing between the drum 20 and the boom pivot 29 which effectively increases the distance between the drum 20 and the boom point 40 as the boom 30 is lowered. The third way that the lower load block 46 could come in contact with the upper load block 44 is when the telescoping sections of the boom 32 and 33 are extended without sufficiently letting out the cable 26.

The impacting of the upper load block 44 by the lower load block 46 could cause damage to the load blocks 44 and 46, the boom and the load. Additionally, the continued pulling of the cable, once the lower load block 46 has caught on the upper load block 44 could result in the cable breaking and the lower load block 46 with any attached load falling. Two-blocking creates a situation where expensive damages to the crane's machinery and load may result.

Once past the upper load block 44, the cable 26 is threaded through a cable follower 60, located between the upper and lower load blocks 44 and 46. The cable follower 60 includes a base 62 having an opening 64 slightly greater in diameter than that of the cable 26, and through which the cable 26 freely moves. The cable follower 60 also includes a flexible rod 66 fixed to and extending upwardly from a top 68 of the base 62. The rod 66 has a tree upper end which is adapted to move an actuator 70 for a switch 72.

The switch 72 is attached to an outer surface 73 of the upper load block 44. Adjacent the switch is a U-shaped mounting frame 74 having a back panel 75 and side panels 76 and 77. The actuator 70 extends outwardly from the switch 72 between the panels 76 and 77. The lower side panel 77 has a slot 78 through which an upper end 80 of the rod 66 extends. A protuberance 82 mounted on the free upper end 80 of the rod 66, along with the follower 60, normally biases the rod 66 against the lower panel 77 through the influence of gravity. A cover 84 is attached by bolts 85 over the switch assembly 70. The switch 72 is connected to an electrical cable 86 to control the operation of the mechanism of the crane. The illustrated switch is microprocessor controlled. However, any switch would be appropriate.

When the crane is in a normal working mode and the lower load block 46 is at a safe distance from the upper load block 44, the cable follower 60 through gravity, pulls the rod 66 away from the microswitch actuator thereby allowing the switch 72 to be operational and the crane 10 to function as normal.

The use of a flexible rod 66 takes into account the natural swaying of the load as well as changes in attitude of the boom 30 and prevents premature activation of the switch. The mounting frame 74 and microswitch actuator 70 are mounted at a diagonally downward angle relative the boom point 40 so that the boom 30 can be at any angle and activation by the flexible rod 66 is still affected reliably without binding in the slot 78. The cover 84 functions to protect the switch from the elements.

Figure 3:
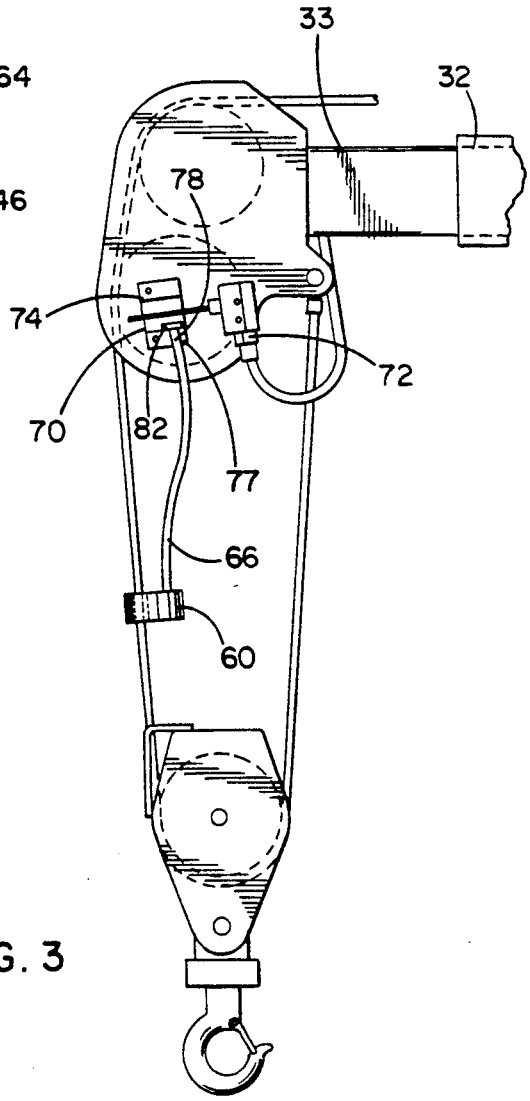
FIG. 3 is a somewhat schematic side elevation of an anti-two block device on a crane while in a working position.

FIGS. 3 and 4 illustrate the anti-two block device before and after actuation. Referring to FIG. 3, the switch actuator 70 is generally perpendicular to the switch 72. The protuberance 82 on the flexible rod 66 rests on the lower side panel 77 of the mounting frame 74 thereby suspending the follower 60 above the lower block 46. Referring to FIG. 4, the length of the flexible rod 66 in its state is such that it represents the minimum distance in which the lower load block 46 is allowed to approach the upper load block 44. When the lower load block 46 approaches too close to the upper load block 44, the lower load block 46 exerts an upward force on the cable follower 60, causing the flexible rod 66 to exert an upward force on the microswitch actuator 70, thus activating the microswitch 72.

Referring to FIG. 2, the lower load block 46 is comprised of two side panels 90 and 91 and a top panel 92. Each of the side panels 90 and 91 has an L-shaped rod 93 and 94, respectively, welded thereon. The two rods 93 and 94 are welded in parallel. One end of each rod 93 and 94 is welded to the top of the respective side panels 90 and 91 adjacent opposite sides of one end of the top panel 92. The other ends of the rods 93 and 94 are each welded to one side of the respective side panels 90 and 91 so that outwardly extending corners are formed on the lower block 46 beneath the cable follower 60. The rods facilitate positive engagement of the lower block 46 with the follower 60 to activate the switch 72.

FIG. 5 shows a schematic of the electrical connections of the crane 10. The switch 72 cuts off power to the controls 88 which may be of conventional construction to operate the drum 20 which hoists the cable 26 as well as the boom elevation cylinder 36 and the extension cylinder (not shown). In that way, when the flexible rod 66 pushes up against the microswitch actuator 70, all the movement which would continue the lower block 46 towards the upper block 44 is stopped and the controls are disabled until the drum control is operated to pay out sufficient cable 26 to allow the follower 60 to be lowered, thereby releasing the switch 72 to return to its initial state.

There are many advantages of this invention which are readily apparent from the foregoing. One advantage of this design over the prior art in this area is that this system does not require the prolonged or continuous exertion of a force on the switch. Current anti-two block systems use a weight attached to a chain attached in turn to a lever of a microswitch. When the lower load block comes in contact with the weight, tension is relaxed on the switch which stops movement of the crane so that the lower block never comes in contact with the sheave assembly. Such systems require weights to continually exert pressure on switches unless a problem arises. This, in turn, may induce early switch failure. The current system does not require an exertion of a constant force on the switch. The present system relies on a mild positive upward force on a switch actuator to stop movement of the crane. This is a great advantage over prior systems since the life span of the switch and integrity of the system is increased.

The use of a flexible rod provides another advantage over prior anti-two block systems. As mentioned previously, a non-flexible rod is vulnerable to the swaying of the wind and the movement of the crane. In contrast, the flexible rod only activates the microswitch when the lower block is approaching too close to the sheave assembly. The use of a flexible rod and a cable follower to activate a microswitch is an improvement in the design of an anti-two block device over devices which use a chain and weight on a microswitch.

I claim:

1. An anti-two block device for preventing a lower load block suspended by an upper load block from contacting the upper load block, said device comprising:

a switch including a switch actuator for controlling the movement of the lower and upper load blocks;

a cable follower for detecting the presence of the lower load block within a predetermined distance from the upper load block; and a flexible rod attached to said cable follower, said flexible rod having of free end spaced from and unattached to said switch actuator when the lower load block is not in contact with said cable follower, and engageable with said switch actuator when the lower load block exerts a force on said cable follower, for deactivating said switch thereby stopping movement of the upper and lower blocks.

2. The device as in claim 1 wherein said switch is a microswitch.

3. A device for preventing two blocking in a crane assembly having a boom with inner and outer ends, an upper load block attachment to said outer and, a cable extending vertically from the upper load block, a lower load block suspended by the cable and means for moving the lower load block relative the upper load block, said device comprising:

a cable follower between the upper load block and having a switch actuator for controlling movement of components on the crane assembly; and a flexible rod having a lower and upper end, said lower end being attached to said cable follower and said upper end being a free end spaced from and unattached to said switch actuator when the lower load block is not in contact with said cable follower, and engageable with said switch actuator when said follower is in contact with the lower load block, said switch being adapted to control the means for moving the lower load block relative the upper load block so that engagement of the switch actuator by said rod ceases all movements of the lower block towards the upper load block.

4. The device as in claim 3, wherein the crane assembly includes means for raising and lowering the boom, deactivation of the switch causes the boom to stop being lowered.

5. The device as in claim 3, wherein the crane assembly includes a telescoping boom and means for extending and retracting the boom, deactivation of the switch causes the boom to stop being extended.

6. The device as in claim 3, wherein the crane assembly includes a means for reeling in and paying out the cable, deactivation of the switch causes the reeling in of the cable to be halted.

7. The device of claim 3 wherein said cable follower contains an opening greater in diameter than the diameter of the cable and through which the cable freely passes.

8. A crane apparatus comprising:

a boom having inner and outer ends;

a load block assembly including upper and lower blocks;

a cable extending vertically between said upper and lower load blocks;

a hoisting mechanism for reeling in and paying out said cable;

a cable follower between said upper and lower load blocks;

a flexible rod having a lower end and an upper free end, attached to said cable follower at said lower end; and a switch and switch actuator mounted in adjacency to said upper load block, the upper free end of said flexible rod being spaced from and unattached to said switch actuator when the lower load block is not in contact with said cable follower and being engageable with said switch actuator when said cable follower is contacted by said lower load block, said switch being adapted to control said hoisting mechanism so that upward movement of said switch actuator ceases the reeling in of said cable.

9. The crane apparatus of claim 8 wherein said cable follower contains an opening, greater in diameter than the diameter of said cable, through which said cable freely passes.

10. The crane apparatus of claim 8 further comprising a housing partially defining said upper load block and on which said switch is mounted.

11. The crane apparatus of claim 8 further comprising a telescoping boom, wherein said switch controls extension of said boom.

12. The crane apparatus of claim 8 further comprising means for elevating said boom, wherein said switch controls elevation of said boom.

13. The crane apparatus of claim 12, wherein said switch is mounted at a diagonally downward angle relative the boom outer end such that said actuator is maintained at a generally downward direction independent of the elevation of said boom.

14. The crane apparatus of claim 8 wherein said lower load block comprises a housing with two parallel spaced side panels, having two spaced L-shaped rods affixed thereon in parallel, with each rod attached to the top and side of a separate panel, said rods being adapted to engage said cable follower as said lower load block approaches said upper load block.

15. The crane apparatus of claim 8 wherein said upper end of said flexible rod is below said switch actuator and in spaced relationship to said actuator on said switch and movable upward into engagement with said actuator.

* * * * *